US005551164A

United States Patent [19]

Brunnmair et al.

[11] Patent Number: 5,551,164

[45] Date of Patent: Sep. 3, 1996

[54] DRYING SECTION WITH AN ADJACENT FINISHING ROLLER

[75] Inventors: Erwin Brunnmair, Graz, Austria; Alfred Bubik, Ravensburg, Germany; Harald Hess, Grunkraut, Germany; Herbert Holik, Ravensburg, Germany; Werner Leitenberger, Schlier-Wetzisreute, Germany; Thomas Merath, Oberteuringen, Germany; Johann Moser, Grunkraut, Germany; Helmut Steib, Schlier, Germany; Elmer Weisshuhn, Vogt, Germany

[73] Assignee: Voith Sulzer Papiermaschinen GmbH, Heidenheim, Germany

[21] Appl. No.: 398,668

[22] Filed: Mar. 3, 1995

[30] Foreign Application Priority Data

Mar. 5, 1994 [DE] Germany ..... 44 07 405.0

[51] Int. Cl.[6] ..... F26B 11/02

[52] U.S. Cl. ..... 34/117; 162/359.1; 34/118; 34/119

[58] Field of Search ..... 34/111, 113, 116, 34/117, 123, 126, 128, 129, 620, 628, 636, 637, 665, 663; 162/270, 289, 358.3, 358.5, 360.2, 359.1

[56] References Cited

U.S. PATENT DOCUMENTS

| | | | |
|---|---|---|---|
| 4,014,740 | 3/1977 | Koponen et al. | 162/289 |
| 4,934,067 | 6/1990 | Wedel . | |
| 5,105,561 | 4/1992 | Wulz | 34/117 |
| 5,127,168 | 7/1992 | Pikulik . | |
| 5,169,501 | 12/1992 | Meinecke | 34/117 |
| 5,355,593 | 10/1994 | Kotischke | 34/117 |
| 5,388,347 | 2/1995 | Kerttula et al. | 34/117 |
| 5,426,867 | 6/1995 | Yli-Kauppila et al. | 34/117 |
| 5,431,787 | 7/1995 | Braun et al. | 162/358.3 |

FOREIGN PATENT DOCUMENTS

| | | |
|---|---|---|
| 0141614 | 5/1985 | European Pat. Off. . |
| 151447A | 8/1985 | European Pat. Off. . |
| 0345501 | 11/1992 | European Pat. Off. . |
| 2522965 | 12/1975 | Germany . |
| 92-19809 | 11/1992 | WIPO . |
| 9323614 | 11/1993 | WIPO . |

*Primary Examiner*—John M. Sollecito
*Assistant Examiner*—Steve Gravini
*Attorney, Agent, or Firm*—Greenblum & Bernstein P.L.C.

[57] ABSTRACT

A drying section of a papermaking machine includes several drying groups with at least one drying screen each. At the end of one drying group and/or at the beginning of the next following drying group, a finishing roller is utilized. A finishing nip is formed between one of two finishing rollers and a finishing roller and a drying cylinder of an adjacent drying group. Only the paper web is conveyed through the finishing nip.

28 Claims, 3 Drawing Sheets

DRYING SECTION WITH AN ADJACENT FINISHING ROLLER

CROSS REFERENCE TO RELATED APPLICATIONS

This application claims the priority of German Application No. DE-P 4407405.0, filed Mar. 5, 1994, the disclosure of which is incorporated herein by reference in its entirety.

BACKGROUND OF THE INVENTION

1. Field of the Invention

This invention pertains to a drying section of a papermaking machine, the drying section including several drying groups and a paper web, wherein the paper web, together with at least one endless drying screen, associated with each of the several drying groups, is guided over heated drying cylinders, wherein the paper web is located between a drying screen and a drying cylinder.

2. Discussion of the Background of the Invention and Material Information

U.S. Pat. No. 4,934,067 sets forth a drying section in which the drying groups are therein connected in that the drying sieves or screens of both subsequently following groups are brought together in the transfer region and brought into contact with the intermediately located or interposed web. Therein, the drying screens of both drying groups are conveyed over suction rollers that are located after the last or before the first drying cylinder. Such devices, via the avoidance of an open draw of the paper web, act against web buffeting as well as web tearing.

In addition, European Patent Publication EP 141614 suggests a solution for pre-finishing the paper web at a heated drying cylinder wherein the paper web is conveyed, together with a felt, through the gap or nip formed via the press rollers and the finishing cylinder. The disadvantage is that the paper web is prefinished only on one side thereof.

It is the task or object of this invention to produce a drying section which includes the smallest possible open draw between the drying groups and permits pre-finishing of both sides of the paper web at low cost.

SUMMARY OF THE INVENTION

The task or object is achieved via the device or apparatus set forth in the appended claims. Specifically, in a first embodiment of this invention the drying section of a papermaking machine includes several drying groups and a paper web, wherein the paper web, together with at least one endless drying screen, associated with each of the several drying groups, is guided over heated drying cylinders, with the paper web being located between a drying screen and a drying cylinder, and wherein a finishing roller is provided at one of the end of one drying group and at the beginning of the next following drying group, with the finishing roller, together with the drying cylinder of the adjacent drying group, forming a finishing nip, and with only the paper web being guided through the finishing nip.

In a variation the previous embodiment, the finishing roller has a diameter substantially smaller than that of the drying cylinder.

Another embodiment of the drying section of the papermaking machine of this invention includes several drying groups and a paper web, wherein the paper web, together with at least one endless drying screen, associated with each of the several drying groups, is guided over heated drying cylinders, with the paper web being located between a drying screen and a drying cylinder, and wherein finishing roller is provided at both the end of one drying group and at the beginning of the next following drying group, with the finishing rollers together forming a finishing nip, and with only the paper web being guided through the finishing nip.

In a further embodiment of the drying section of this invention, at least one of the finishing rollers or drying cylinders is movably arranged for the separation of the drying groups.

In a differing embodiment of the drying section of this invention, the paper web partially envelops both of the finishing rollers or the drying cylinders that combine to form the finishing nip, wherein the paper web is in contact with the drying screen over a portion of the region of envelopment of the respective drying groups.

In still another embodiment of the drying section of this invention, the finishing roller includes an elastic covering.

In still a further embodiment of the drying section of this invention, the finishing roller is heated.

In a variation of the previous embodiment the finishing roller is heated on one of the inside, the outside and the inside and outside thereof.

As set forth in the appended claims, one solution consists of utilizing a finishing roller at the end of one drying group or at the beginning of the next following drying group, wherein this finishing roller, together with the drying cylinder of the adjacent or neighboring drying group, forms a finishing gap or nip.

In addition, in a further claimed solution, a finishing roller is utilized both at the end of one drying group and at the beginning of the next following drying group, which finishing rollers coact to form a finishing nip.

In both noted instances, only the paper web is conveyed through the finishing nip, and in addition, the diameter of the finishing roller should be substantially smaller than that of the drying cylinder.

It is also feasible that the finishing rollers are deflection-controlled and have a flexible covering. This enables the influencing of the finishing or smoothing profile laterally, relative to the paper web, in a desired manner, and in addition thereto, to gently finish the paper web via a "soft" finishing nip. In this connection, the formation of a wide finishing nip, such as for example via the use of a correspondingly shaped finishing roller of the type set forth in European Patent Publication EP 345501, is recommended.

In order to improve the finishing result it is also possible to heat the interior and/or exterior of the finishing roller. Even with finishing rollers that have an elastic covering, heating can be accomplished from the outside, for example in the manner set forth in Patent Publication WO 92/19809, wherein the covering is enveloped with a readily thermally conductive layer. This publication also describes the deflection-controlling of a roller of this type.

If the finishing nip is formed of two finishing rollers, a number of differing combination possibilities can result, depending upon the requirements relative to the desired finishing result, or in dependence upon the properties of the incoming paper web. Noted herein is merely the use of a finishing roller having a rigid roller covering or jacket and of another finishing roller with an elastic covering, wherein only one of the two finishing rollers is deflection-controlled and wherein, preferably, the finishing roller with the rigid covering, is heated.

It is also advantageous if at least one of the two finishing rollers or drying cylinders, for the separation of the drying groups, is movably journalled, for example, via a lever.

In order to sufficiently guide the paper web over the full extent of the drying section, the paper web should partially envelop or surround the finishing rollers or drying cylinders that form the finishing nip. In addition, it is advantageous if the paper web is in contact with the respective drying screen over the largest possible portion of the region of envelopment of the respective drying groups.

Problems, with reference to the eventually required length changes of the paper web, resulting from the finishing forces, in the web moving direction, can be countered in that the finishing roller, after or downstream of the finishing nip, is heated and/or provided with an elastic covering, and/or that after the downstream finishing roller or drying cylinders, there is a short open draw of the paper web. In addition, the paper web, after passing through the finishing nip, can be increasingly heated from the outside.

While the length change, due to finishing, is balanced or compensated by shrinkage of the paper web via the heating thereof, this is made possible via the open draw by means of a speed differential between the drying groups and their elastic coverings due to the relaxation of the covering downstream of the finishing nip. Adjustment of the length of the open draw is accomplished by changing the felt path, particularly a position change via the use of at least one reversing roller in the region between two drying groups.

BRIEF DESCRIPTION OF THE DRAWINGS

The invention will be better understood and objects other than those set forth above will become apparent when consideration is given to the following detailed description thereof which is made with reference to three embodiments. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS AND BEST MODE

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
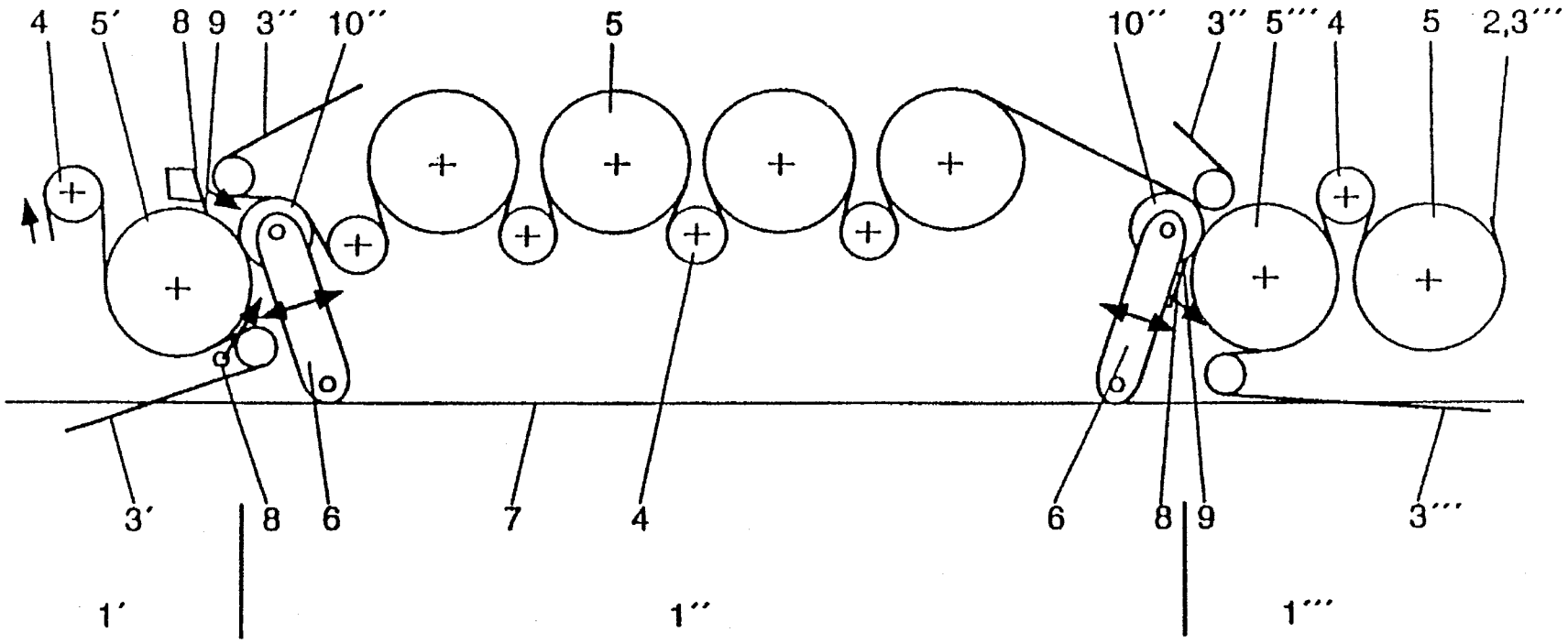
FIG. 1 is a schematic side view of a portion of a drying section as per a first embodiment thereof.
Figure 2:
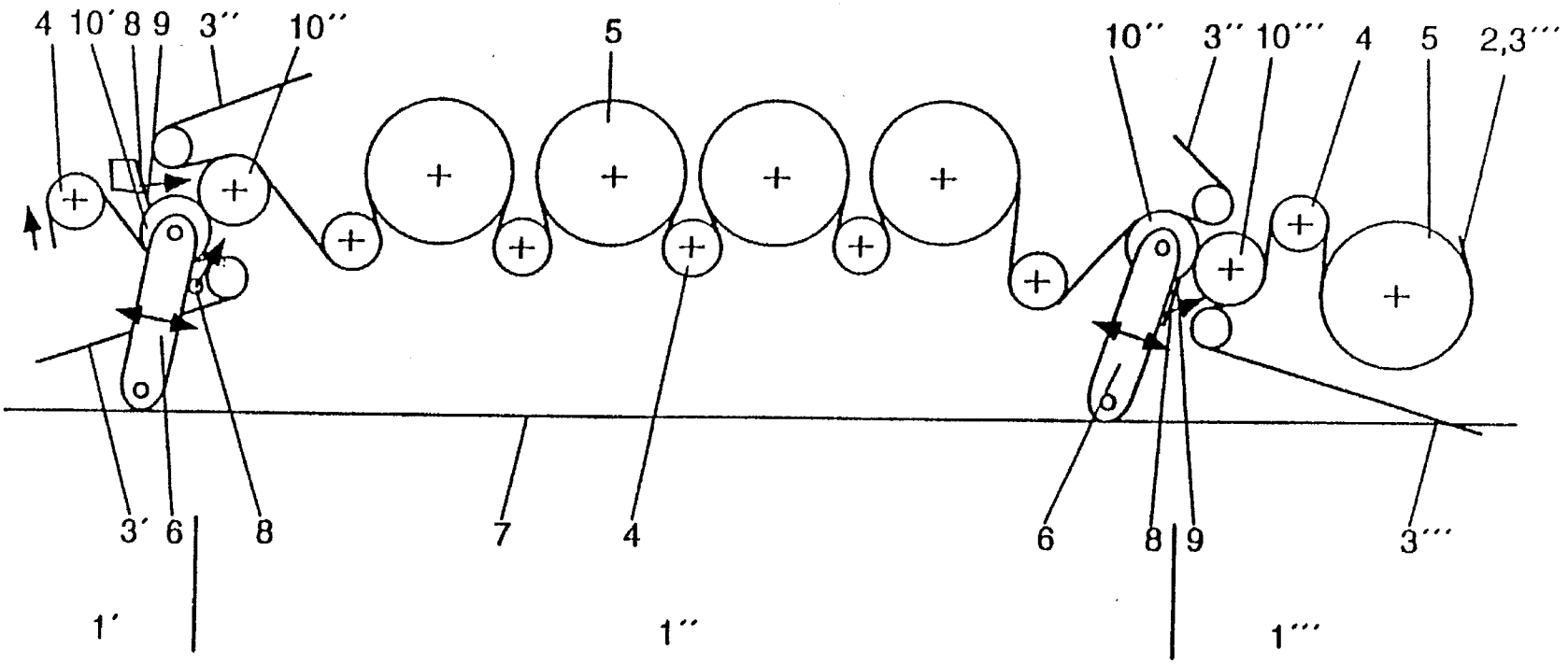
FIG. 2 is a schematic side view as per a second embodiment thereof.

Both of the embodiments of FIGS. 1 and 2 utilize a drying section comprised of several drying groups, 1', 1" or 1''', in which a paper web or path 2, together with at least one endless, porous, dry sieve or screen 3', 3" or 3''', associated with each of the several groups 1', 1" or 1''', is alternately guided over reversing rollers 4, preferably of the suction type, and heated drying cylinders 5, 5' or 5''', wherein paper web 2 is located between the respective drying cylinder 5, 5' or 5" and the associated dry sieve 3', 3" and 3" or 3''' and wherein, in drying groups 1', 1" and 1''' only one side of paper web 2, which side changes from drying group to drying group, comes into contact with drying cylinders 5, 5' and 5".

However, in the embodiment illustrated in FIG. 1, at both the beginning and end of a drying group 1" a finishing or smoothing roller 10" is utilized, with rollers 10" combining with the last drying cylinder 5' of the prior drying group 1' and the first drying cylinder 5''' of the following or next drying group 1''', to form a finishing gap or nip, through which only paper web 2 is conveyed. It is however also possible to utilize a finishing roller only at the end of one of drying groups 1', 1" and 1''' which cooperates with the drying cylinder of the neighboring or adjacent drying group 1', 1" and 1'''.

Finishing rollers 10', 10" and 10''' in general have a substantially smaller diameter than drying cylinders 5, 5' and 5''' and, depending upon requirements, can be deflection-controlled, heated and/or provided with a flexible covering.

The second embodiment, illustrated in FIG. 2, shows a further possibility for solving the same task with similar means or elements. In distinction to FIG. 1, here the adjacent drying groups 1', 1" and 1''', at each of the respective beginnings and ends of drying groups 1', 1" and 1''', utilize a respective finishing roller 10', 10" and 10''' which together form a finishing gap or nip, through which, again, only paper web 2 is conveyed.

Finishing rollers 10', 10" and 10''' can be constructed in the same manner as those described with reference to the first embodiment, wherein of course, depending upon requirements, there are other possibilities to differently arrange finishing rollers 10', 10" and 10''' for forming a corresponding finishing nip.

In order to assure adequate guiding of paper web 2, web 2 should al least partially envelop finishing rollers 10', 10" and 10''' and drying cylinders 5' and 5''', which combine to form a finishing nip, whereby paper web 2 is in contact with the largest possible portion of the enveloping or contact region with drying screen 3', 3" and 3''' of corresponding drying groups 1', 1" and 1''' This as well as the following description applies to both embodiments.

It is advantageous if at least one of the two finishing rollers 10', 10" or 10''' and/or drying cylinders 5' and 5''', which combine to form a finishing nip, is movably mounted in order to separate drying groups 1', 1" and 1'''. This can easily be achieved in that the respective drying cylinder 5' or 5''' or finishing roller 10', 10" and 10''', is journalled on both sides in an electromechanically adjustable arm or lever 6 that is journalled in the vicinity of machine base plane 7.

In order to aid in the insertion or lead-in of paper web 2, preferably blower units 8 are utilized which, as illustrated, can be attached to scraper mechanisms 9 for aiding in stripping off paper web 2.

Thus it is possible, via simple means or elements, for the creation of a finishing gap or nip for the pre-finishing of paper web 2, to achieve a connection between drying groups 1', 1" and 1''', without an open draw in paper web 2

In addition, this device or apparatus also provides the possibility for the saving or elimination of reversing rollers 4, when, for example as can be seen in FIG. 1, in the transfer to drying group 1''', paper web 2 is not reversed between drying cylinder 5 and finishing roller 10".

Figure 3:
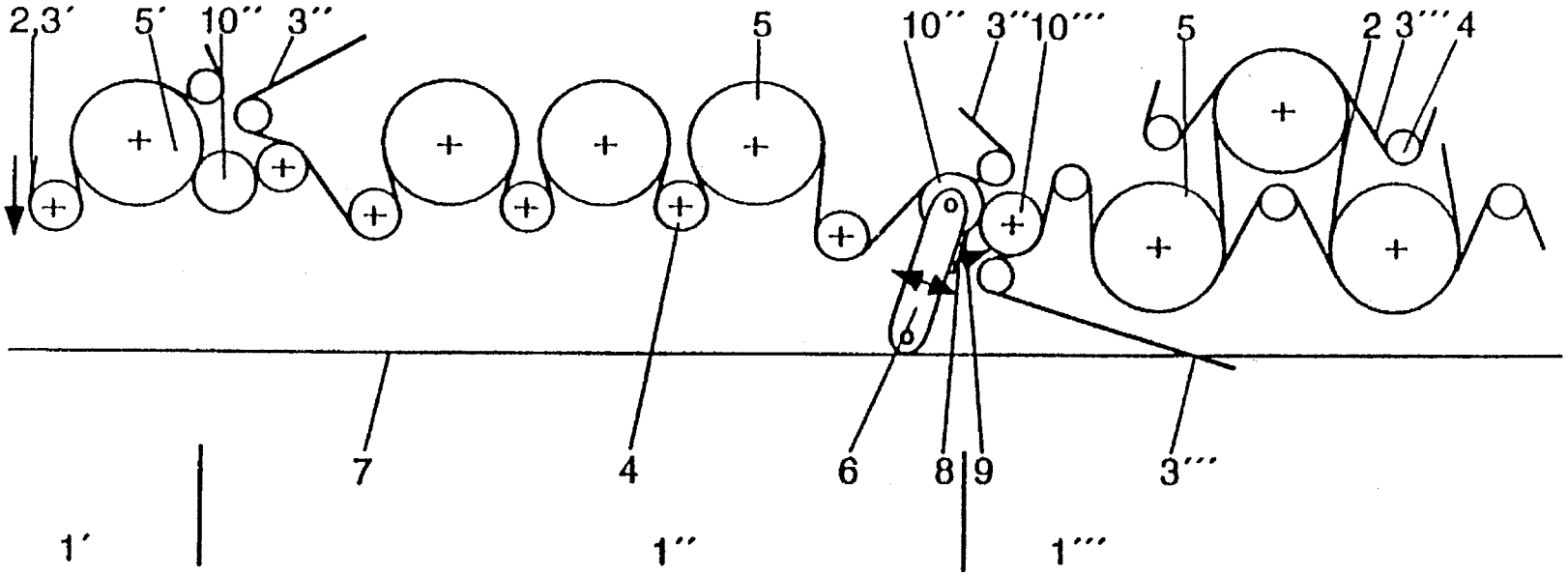
FIG. 3 is a schematic side view as per a third embodiment thereof.

The embodiment illustrated in FIG. 3 makes it clear that the invention is not restricted to a special combination of drying groups of one kind. From a plurality of possibilities, two are shown here, wherein drying groups 1' and 1" correspond with the previously described drying groups.

The difference however lies in the fact that the same side of paper web 2 comes into contact with drying cylinders 5 or 5'. At the same time, at the beginning of drying group 1" a finishing roller 10" is utilized, with roller 10" forming a finishing nip with the last drying cylinder 5' of previous drying group 1', through which nip only paper web 2 is conveyed. Paper web 2 is removed from finishing roller 10", preferably via a suction roller 4 and brought into contact with drying screen 3".

The next-following drying group 1''' pertains to a twin or dual-draw drying group, consisting of an upper and a lower row of mutually offset drying cylinders 5, whose axes are generally so offset relative to each other that each axis in a row thereof is located between two adjacent axes of the other row, as well as each time having drying screen 3''' facing one of the upper and one of the lower rows of drying cylinders 5. Drying screens 3''' are guided or conveyed therein, each time, over two reversing rollers 4 that are located between linearly arranged adjacent drying cylinders 5 and the outer circumferential regions of drying cylinders 5. Paper web 2 meanders between the upper and lower rows of drying cylinders 5 and is retained on drying cylinders 5 via drying screens 3'''.

A finishing roller 10", 10''' is located at both the end of drying group 1" and at the beginning of drying group 1''' and combine to form a finishing nip, through which only paper web 2 is conveyed. Obviously in this embodiment the pre-finishing is achieved on both sides with simple means or elements while having only a minimal free draw in paper web 2.

With reference to the design or structure of drying cylinder 5' as well as finishing cylinder 10" and 10''', reference should be made to the description of FIGS. 1 and 2.

For the connection of two drying groups 1', 1" and 1''' not only one of the solutions set forth in claims 1 and 2 is advantageously utilized. In addition thereto, in the multitude of possibilities, it should be especially be noted that two dual or twin draw drying groups are adjacently arranged.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A drying section of a papermaking machine, the drying section including several drying groups and a paper web, each of the several drying groups comprising at least one endless drying screen and at least one heated cylinder, wherein the paper web is guided over the heated drying cylinders, such that the paper web is located between the at least one drying screen and an associated one of the at least one drying cylinder, wherein a finishing roller is provided at one of a trailing end of a drying group and at a leading end of a drying group, with the finishing roller and an adjacently positioned drying cylinder forming a finishing nip in which only the paper web is guided through the finishing nip.

2. A drying section of a papermaking machine, the drying section including several drying groups and a paper web, wherein the paper web, together with at least one endless drying screen, associated with each of the several drying groups, is guided over heated drying cylinders, wherein the paper web is located between a drying screen and a drying cylinder, wherein a finishing roller is provided at both the end of one drying group and at the beginning of the next following drying group, with the finishing rollers together forming a finishing nip, and with only the paper web being guided through the finishing nip.

3. The drying section of claim 1, wherein the finishing roller has a diameter smaller than that of the drying cylinder.

4. The drying section of claim 1, wherein at least one of the finishing roller and the adjacently positioned drying cylinder is movably arranged for the separation of the drying groups.

5. The drying section of claim 2, wherein one of the at least one of the finishing rollers and drying cylinders is movably arranged for the separation of the drying groups.

6. The drying section of claim 3, wherein at least one of the finishing roller and the adjacently positioned drying cylinder is movably arranged for the separation of the drying groups.

7. The drying section of claim 1, wherein the paper web partially envelops at least one of the finishing roller and the adjacently positioned drying cylinder that form the finishing nip, wherein the paper web is in contact with the drying screen over a portion of a region of envelopment of the drying groups.

8. The drying section of claim 2, wherein the paper web partially envelops one of both of the finishing rollers and the drying cylinders that combine to form the finishing nip, wherein the paper web is in contact with the drying screen over a portion of the region of envelopment of the respective drying groups.

9. The drying section of claim 3, wherein the paper web partially envelops at least one of the finishing roller and the adjacently positioned drying cylinder that form the finishing nip, wherein the paper web is in contact with the drying screen over a portion of a region of envelopment of the drying groups.

10. The drying section of claim 4, wherein the paper web partially envelops at least one of the finishing roller and the adjacently positioned drying cylinder that form the finishing nip, wherein the paper web is in contact with the drying screen over a portion of a region of envelopment of the drying groups.

11. The drying section of claim 1, wherein the finishing roller Includes an elastic covering.

12. The drying section of claim 2, wherein the finishing roller includes an elastic covering.

13. The drying section of claim 3, wherein the finishing roller includes an elastic covering.

14. The drying section of claim 4, wherein the finishing roller includes an elastic covering.

15. The drying section of claim 7, wherein the finishing roller includes an elastic covering.

16. The drying section of claim 1, wherein the finishing roller is heated.

17. The drying section of claim 2, wherein the finishing roller is heated.

18. The drying section of claim 3, wherein the finishing roller is heated.

19. The drying section of claim 4, wherein the finishing roller is heated.

20. The drying section of claim 7, wherein the finishing roller is heated.

21. The drying section of claim 11, wherein the finishing roller is heated.

22. The drying section of claim 16, wherein the finishing roller is heated on one of the inside, the outside and the inside and outside thereof.

23. The drying section of claim 17, wherein the finishing roller is heated on one of the inside, the outside and the inside and outside thereof.

24. The drying section of claim 18, wherein the finishing roller is heated on one of the inside, the outside and the inside and outside thereof.

25. The drying section of claim 19, wherein the finishing roller is heated on one of the inside, the outside and the inside and outside thereof.

26. The drying section of claim 20, wherein the finishing roller is heated on one of the inside, the outside and the inside and outside thereof.

27. The drying section of claim 21, wherein the finishing roller is heated on one of the inside, the outside and the inside and outside thereof.

28. The drying section of claim 1, wherein the at least one endless drying screen is unique to each of the several drying groups.

* * * * *